United States Patent [19]

Cruise, Jr.

[11] 4,123,021

[45] Oct. 31, 1978

[54] KITE LOAD-RELEASING MESSENGER

[76] Inventor: Claude R. Cruise, Jr., 2008 Virginia Hgts. Dr., Bluefield, W. Va. 24701

[21] Appl. No.: 835,457

[22] Filed: Sep. 22, 1977

[51] Int. Cl.[2] ..... A63H 27/08

[52] U.S. Cl. ..... 244/155 R

[58] Field of Search ..... 244/155 R; 46/86 R

[56] References Cited

U.S. PATENT DOCUMENTS

| | | | |
|---|---|---|---|
| 1,718,551 | 6/1929 | Fisher | 244/155 R |
| 2,279,152 | 4/1942 | Whitehurst | 244/155 R |
| 3,961,764 | 6/1976 | Keough | 244/155 R |

*Primary Examiner*—Barry L. Kelmachter

*Attorney, Agent, or Firm*—John F. McClellan, Sr.

[57] ABSTRACT

A load carrying messenger for releasing parachutes and other objects from kites includes a pendant slider-supported body for engaging a kite string, having spring-apart jaws held shut by a pivot sear released when a forwardly extending trigger sliding along the kite string strikes a messenger-stop such as a button secured on the line at the kite.

9 Claims, 3 Drawing Figures

KITE LOAD-RELEASING MESSENGER

This invention relates generally to amusement devices and particularly to kite apparatus.

In the prior art it is known to send "messengers" to kites; in the simplest form a paper sheet with the kite string threaded through a hole will rise along the string to the kite.

A principal object of the present invention is to provide a load carrying messenger which will release a parachute when it reaches a preset-obstacle on the line near the kite, and which can then return down the line for quick reuse, providing greater enjoyment and teaching more skills in kite flying.

Further objects are to provide a device as described which is safe to use, being lightweight with few parts, all coupled together, and employing three connections with the kite string on which used, lessening chances of accidental detachment.

Still further objects are to provide a device as described which can be pretested and adjusted before attachment on a kite string, which slides freely on the line, which provides leverage-release for positive snap-action coupled with a "flag" type member showing the state (set or released) from great distances, which has little wind resistance, which can carry relatively heavy weights, which can be used with almost any type and size line, which is easy to learn to use and easy to use, which is reliable, jam resistant, durable, simple, cheap and easy to manufacture, and which is attractive in appearance.

In brief summary given for cursive descriptive purposes only and not as limitation, the invention includes slider-supported snap-open jaw structure released by a forwardly extending trigger.

The above and other objects and advantages of this invention will become more readily appreciated on examination of the following description, including the drawings in which like reference numerals indicate like parts:

FIG. 1 shows a messenger 10 according to this invention which has just slid up the string S of a kite K held by a flyer F, struck a preset button B, and released a parachute P. A second parachute similarly carried is shown advancing up the kite string.

It can be seen that in relation to the kite and to the load carried, the invention is relatively small. In this use and at this attitude, it can be seen also that one unit of the invention, released of the sail area provided by the parachute, can slide back down the line and quickly be available for a further trip up the line with another parachute, as in a contest.

Figure 1:
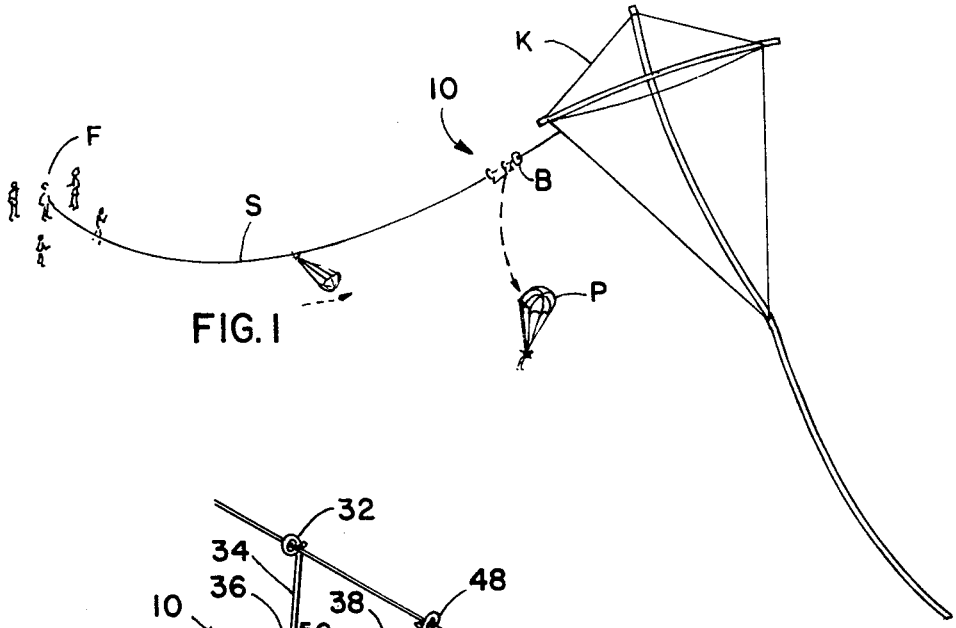
FIG. 1 is a perspective view from above showing the invention in use on a kite string.
Figure 2:
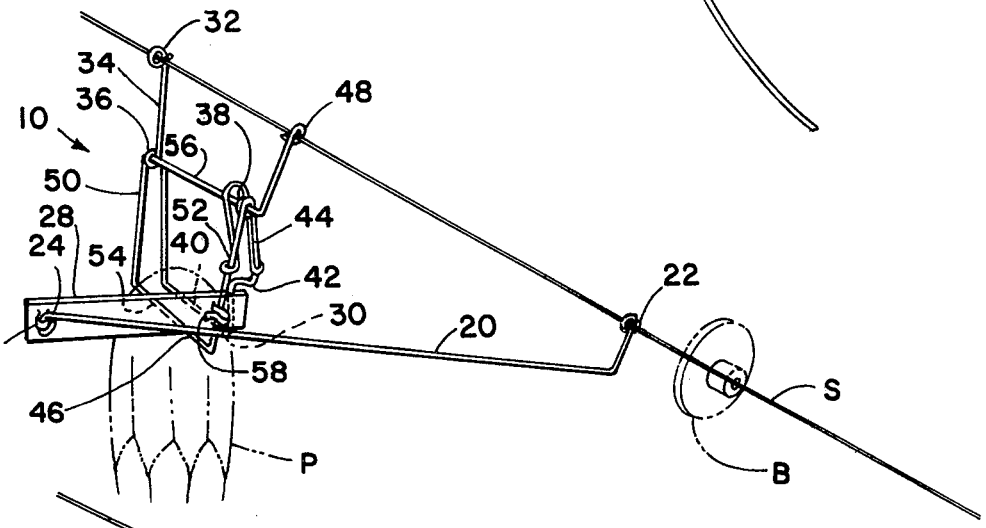
FIG. 2 is a perspective view of the invention in load-carrying configuration.

FIG. 2 shows details of the invention 10 in loaded or set configuration, holding a parachute P, and approaching a button B frictionally or otherwise suitably affixed on a kite string S. In this and the next Figure, an optional method of carrying a parachute, by the canopy instead of the parachute load, is shown.

In operation the forwardly extending trigger slides along the kite string until it strikes the button, thrusting the trigger to the rear and pivoting the arm to which the rear of the trigger attaches, releasing the sear on the arm, and allowing the two opposed jaws of the device to be sprung apart by the horseshoe-shaped spring, releasing the load carried between the arms.

The trigger 20 is a rod with an open loop 22 at the forward end sized for slidably and detachably engaging the kite string and positively stopping against a button or other obstacle on the kite string, and with a closed loop 24 at the rearward end pivotally engaging a hasp 26 on a first end of arm 28. The arm is rigid and is pivoted at the second end to a first jaw 30 which passes through it. The first jaw is in the general form of a squared fishhook modifed to have three loops and an offset.

The first loop 32 is open and at the top of the long shank 34 for slidably and detachably engaging a kite string. The second loop 36 is halfway down the shaft and serves as a pivot to the second jaw, as does the third loop 38 which is at the top of the short shank laterally spaced from the first loop. A transverse length 40 connects the two shanks at the bottom. An offset 42 in the short shank limits upward sliding of the arm, which pivots to the shank portion below it in a pivotal arc extending through the second jaw, and also holds up one end of horseshoe-shaped spring 44 which urges the jaws apart.

The second jaw 46 is in the form of a squared script capital "A", with a kite string engaging loop 48 at the free end, and the remaining portion forming a rectangle with ends 50, 52, connecting a transverse length 54 at the bottom matching the first jaw lower portion, and transverse length 56 at the top to which the first-jaw second and third loops pivot, and which is straddled by the horseshoe-shaped spring.

Hooked, rounded resilient sear 58 forwardly extends from an intermediate portion of the arm adjacent the arm pivot in position to engage and hold the forward end 52 of the second jaw when the jaws are compressed together, as for pinching and retaining the top of a parachute canopy. The free length of the arm is made such as to provide a mechanical advantage of at least three-to-one in the action of the trigger to assure positive actuation, which is most important since the actuating forces involved remote from the kite flyer are necessarily of low order.

Rounded shape of the sear, and resilience, make it possible to set the device adjustably.

Figure 3:
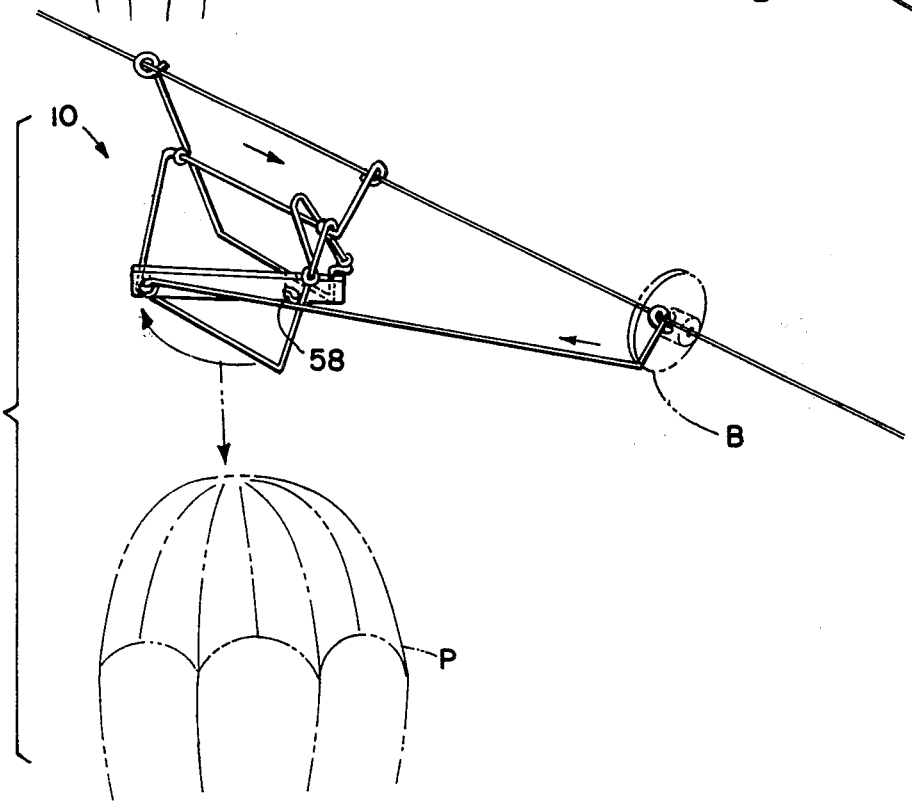
FIG. 3 is a perspective view of the invention in load-release configuration.

FIG. 3 shows how the sear 58 releases the forward end of the second jaw and the jaws spring apart when the trigger strikes or is struck by a button B, instantly releasing the load.

It can be seen that the location of the spring proximate the sear localizes loads on the generally resilient jaws, improving grasping retention and reliability.

Materials for the invention can be wire for all parts, if desired, the spring being of spring steel or other suitable material; in the embodiment shown the body of the arm is rigid red plastic which is visible from a long distance when perpendicular to the kite string in the set position. Alternatively, the entire mechanism can be molded of any suitably hard and resilient plastic such as polypropylene, or otherwise suitably fabricated, since materials are not critical.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States letters patent is:

1. In a messenger for kites having means for slidably engaging a kite string having an obstruction thereon proximate a flying kite, the improvement comprising: the means for slidably engaging supporting a body having first and second jaws in opposed relation for releasably holding a parachute, means urging all said jaws apart, means for holding all said jaws together releasably, means for releasing the holding means; the means for releasing comprising a member forwardly extending from a first end of the messenger in position to strike said obstruction on said kite string, the forwardly extending member comprising a trigger, the means for slidably engaging including the trigger having at the forward end means for engaging said kite string; the means for holding including an arm having: a pivotal connection to the first jaw, a sear at an intermediate portion of the arm positionable with the arm for holding the second jaw proximate the first jaw, and a pivotal connection to the rearward portion of the trigger.

2. In a messenger as recited in claim 1, said positioning of the arm for holding the second jaw proximate the first jaw being with the arm generally perpendicular to the first and second jaws.

3. In a messenger as recited in claim 2, the arm being of a color aiding visibility for a flyer of said kite using said messenger.

4. In a messenger as recited in claim 1, said intermediate portion location of the sear providing mechanical advantage for the trigger for releasing all said jaws.

5. In a messenger as recited in claim 4, said sear having a rounded portion and being resilient.

6. In a messenger as recited in claim 5, said first and second jaws having a pivotal connection.

7. In a messenger as recited in claim 6, all said slidably engaging means including open loop structure proportioned for detachment from said kite string.

8. In a messenger as recited in claim 7, all said jaws being generally rectangular, and said body being open for offering little wind resistance.

9. In a messenger as recited in claim 4, the means urging comprising a horse-shoe-shaped spring having engagement with the first and second jaws proximate said sear.

* * * * *